US008763723B2

(12) United States Patent
Leppanen et al.

(10) Patent No.: US 8,763,723 B2
(45) Date of Patent: Jul. 1, 2014

(54) CARTRIDGE FOR BREAKING ROCK

(75) Inventors: Jarmo Uolevi Leppanen, East Rand (ZA); Manfred Karl Heinrich Habeck, Somerset West (ZA)

(73) Assignee: Sandvik Mining and Construction RSA (Pty) Ltd (ZA)

( * ) Notice: Subject to any disclaimer, the term of this patent is extended or adjusted under 35 U.S.C. 154(b) by 329 days.

(21) Appl. No.: 13/141,706

(22) PCT Filed: Jan. 28, 2010

(86) PCT No.: PCT/ZA2010/000004
§ 371 (c)(1),
(2), (4) Date: Jun. 23, 2011

(87) PCT Pub. No.: WO2010/088705
PCT Pub. Date: Aug. 5, 2010

(65) Prior Publication Data

US 2011/0266053 A1 Nov. 3, 2011

(30) Foreign Application Priority Data

Jan. 28, 2009 (ZA) ..... 2009/00651

(51) Int. Cl.
*E21B 7/00* (2006.01)

(52) U.S. Cl.
USPC ..... 175/2; 166/299; 102/223; 102/301; 102/313; 102/322

(58) Field of Classification Search
USPC ..... 102/223, 301; 175/2
See application file for complete search history.

(56) References Cited

U.S. PATENT DOCUMENTS

| | | | | |
|---|---|---|---|---|
| 2,660,952 | A | 12/1953 | Mohaupt | |
| 2,928,345 | A | 3/1960 | Kennedy | |
| 3,765,331 | A * | 10/1973 | Montesi | 102/416 |
| 3,765,332 | A * | 10/1973 | Baker et al. | 102/416 |
| 2007/0044673 | A1 * | 3/2007 | Hummel et al. | 102/206 |

FOREIGN PATENT DOCUMENTS

| | | |
|---|---|---|
| WO | 2005/052498 | 6/2005 |
| WO | WO 2008037483 A1 * | 4/2008 |

OTHER PUBLICATIONS

International Search Report & Written Opinion dated ; PCT/ZA2010/000004; International File Date: Jan. 28, 2010; Earliest Priority Date: Jan. 28, 2009; 11 pages.
International Preliminary Report on Patentability; PCT/ZA2010/000004; International File Date: Jan. 28, 2010; Earliest Priority Date: Jan. 28, 2009; 12 pages.

* cited by examiner

*Primary Examiner* — Jennifer H Gay
*Assistant Examiner* — Caroline Butcher
(74) *Attorney, Agent, or Firm* — Schmeiser, Olsen & Watts, LLP

(57) ABSTRACT

A cartridge for breaking rock which includes a tubular housing in which is formed a first compartment. The cartridge includes a first energetic composition inside the first compartment and a primer which is exposed to the first energetic composition. The cartridge includes a second compartment inside the tubular component and a plunger inside the tubular component which is movable under explosive force towards the primer. The cartridge still further includes a second energetic composition inside the second compartment and an actuator and a fuse for initiating the second energetic composition. The actuator has an area which is smaller than the cross-sectional area of the plunger and is movable, by movement of the plunger, towards the primer, and in that the primer is initiated by the actuator only when liquid fills a volume enclosed at least partly by surfaces of the actuator and of the primer.

10 Claims, 3 Drawing Sheets

CARTRIDGE FOR BREAKING ROCK

BACKGROUND OF THE INVENTION

This invention relates to a rock breaking cartridge of the type which makes use of a propellant or an energetic composition to generate high pressure gasses which are used for the breaking of rock.

The energetic composition, through its chemical composition and physical characteristics, upon initiation, deflagrates (burns fast) instead of detonating, and it is necessary to confine a resulting pressure wave to allow for pressure build-up in order to break rock.

If an energetic composition is securely confined inside a cartridge housing, then a high pressure build-up occurs inside the housing and ruptures the housing. If this process takes place because of an accidental initiation of the composition then, depending on the circumstances, injury to personnel or damage to equipment can result. Another factor is that strict rules apply to the storage and transport of this type of cartridge.

At least for the aforegoing reasons it is desirable for a rock breaking cartridge to be capable of generating maximum pressure build-up only if the cartridge is in an operative environment. The safety of the cartridge is thereby inherently increased and transport and storage problems are significantly alleviated.

U.S. Pat. No. 3,765,331 describes a water-armed fuse in which a piston directly acts on a water-filled volume to initiate a primer. The pressure exerted on the primer is directly dependent on the area of the piston, a feature which is not always desirable.

The invention aims to provide a rock breaking cartridge which addresses the aforementioned requirements.

SUMMARY OF INVENTION

The invention provides a cartridge for breaking rock which includes a tubular housing in which is formed a first compartment, a first energetic composition inside the first compartment, a primer which is exposed to the first energetic composition, a second compartment inside the tubular component, a plunger inside the tubular component which is movable under explosive force towards the primer, a second energetic composition inside the second compartment, an actuator and a fuse for initiating the second energetic composition, characterised in that the actuator has an area which is smaller than the cross-sectional area of the plunger and is movable, by movement of the plunger, towards the primer, and in that the primer is initiated by the actuator only when liquid fills a volume enclosed at least partly by surfaces of the actuator and of the primer.

Preferably the actuator forms part of the second compartment.

Preferably the liquid is confined in the volume which is bounded at least partly by surfaces of the detonator and of the primer.

The actuator may be movable only when the second energetic composition generates pressure, inside the second compartment, in excess of a predetermined minimum. This characteristic may be achieved by fixing the actuator in position using a frangible retention formation or formations.

Preferably, upon initiation of the second energetic composition, a pressure wave is created in the liquid which acts as a confinement mechanism at least around the first compartment when the first energetic composition is ignited.

The actuator acts to transfer force to, and exert force on, the primer. This is achieved through the medium of the liquid, typically water, which is trapped in a volume between the actuator and the primer. As water is incompressible the transfer of force from the actuator to the primer can be highly effective. Nonetheless it is important to ensure that the water is effectively confined between the actuator and the primer for, if water does escape from the volume, the water cannot be adequately pressurised. To achieve this objective the actuator should form an enclosure over the primer. The actuator could for example directly engage with an outer surface of the primer to define an enclosed volume which contains water. In an alternative approach the actuator engages with a surface around the primer. This surface is not necessarily part of the primer. In each case though the actuator must still be capable of moving towards the primer to increase pressure and hence the force which is exerted on the primer. Thus a degree of relative movement between the actuator and the primer should be allowed to take place. For example the primer and the actuator may have complementary formations which are relatively movable to some extent and which are located so as to trap liquid between the actuator and the primer. These formations may be in the nature of a piston and cylinder.

Alternatively the actuator may have a leading end which can deform or yield, when it strikes a surface around the primer or when it strikes the primer, in such a way that relative movement between the actuator and primer can take place but without any meaningful escape of liquid between these components. In an alternative form of the invention the surface which is struck[4] by the actuator is, possibly in addition to a similar property in the actuator, deformable or breakable.

The second energetic composition, when initiated, may act on a fairly large surface which, in turn, acts on the actuator. The actuator may be integrally formed with, or otherwise be engaged with, the surface. The actuator on the other hand may have a relatively small area which faces the primer. The pressure on the actuator is increased in accordance with the ratio of the area of the large surface to the area of the actuator. This high pressure causes reliable initiation of the primer.

The cartridge may include a tubular structure or housing in which the first and second compartments are formed. A cavity may be defined between the primer and the actuator and at least one aperture may be formed in a wall of the structure to place an interior of the cavity in communication with liquid which surrounds the structure, when the cartridge is immersed in the liquid.

The first compartment may be larger than the second compartment so that the quantity of the first energetic composition is greater than the quantity of the second energetic composition.

The tubular structure may have a relatively thin side wall to ensure that the volume of the first compartment, at least, is maximised.

The rock breaking cartridge may include an electrically controlled mechanism for firing the fuse.

The construction and operation of the cartridge are such that if the cartridge is located in an operative environment, for example in a water-filled hole in a body of rock, ignition of the second energetic[5] composition results in a twofold consequence namely, the propelling of the actuator towards the primer so that the first energetic composition is initiated, and the expulsion of the cap from the tubular body, into the water, so that a pressure wave which surrounds and confines, at least, the first compartment, is generated when the first energetic composition is initiated.

The cartridge may include an antenna for providing an input signal or power to the electrically controlled mechanism for initiating the fuse. The antenna may be a coil with one or more windings. The windings may be positioned within a protected location and extend around the tubular structure of the cartridge, or part thereof.

The invention also provides a method of initiating a first energetic composition which includes the steps of:

(a) confining a quantity of the first energetic composition in a compartment,
(b) exposing a primer to the first energetic composition,
(c) loading the compartment into a borehole,
(d) surrounding the compartment in the borehole with water,
(e) igniting a second energetic composition in the water thereby to propel an actuator towards the primer,
(f) confining a quantity of water in a volume which is at least partly between the actuator and the primer, and
(g) using the confined water to transmit force from the actuator to the primer thereby to fire the primer and so initiate the first energetic composition.

The second energetic composition may be used to create a pressure wave in the water which confines the first energetic composition when the first energetic composition is initiated.

The quantity of the second energetic composition is relatively small compared to the quantity of the first energetic composition, with a typical ratio being of the order of 1:20. This means that in practice if the second energetic composition is inadvertently initiated only a small release of energy takes place. Under normal conditions this is not necessarily seriously harmful or damaging. On the other hand when the first energetic composition is initiated a substantially greater amount of energy is released. This can take place only when the cartridge is immersed in liquid and effective breaking of the rock in which the borehole is formed, then results.

BRIEF DESCRIPTION OF THE DRAWINGS

The invention is further described by way of example with reference to the accompanying drawings in which.

DESCRIPTION OF PREFERRED EMBODIMENT

Figure 1:
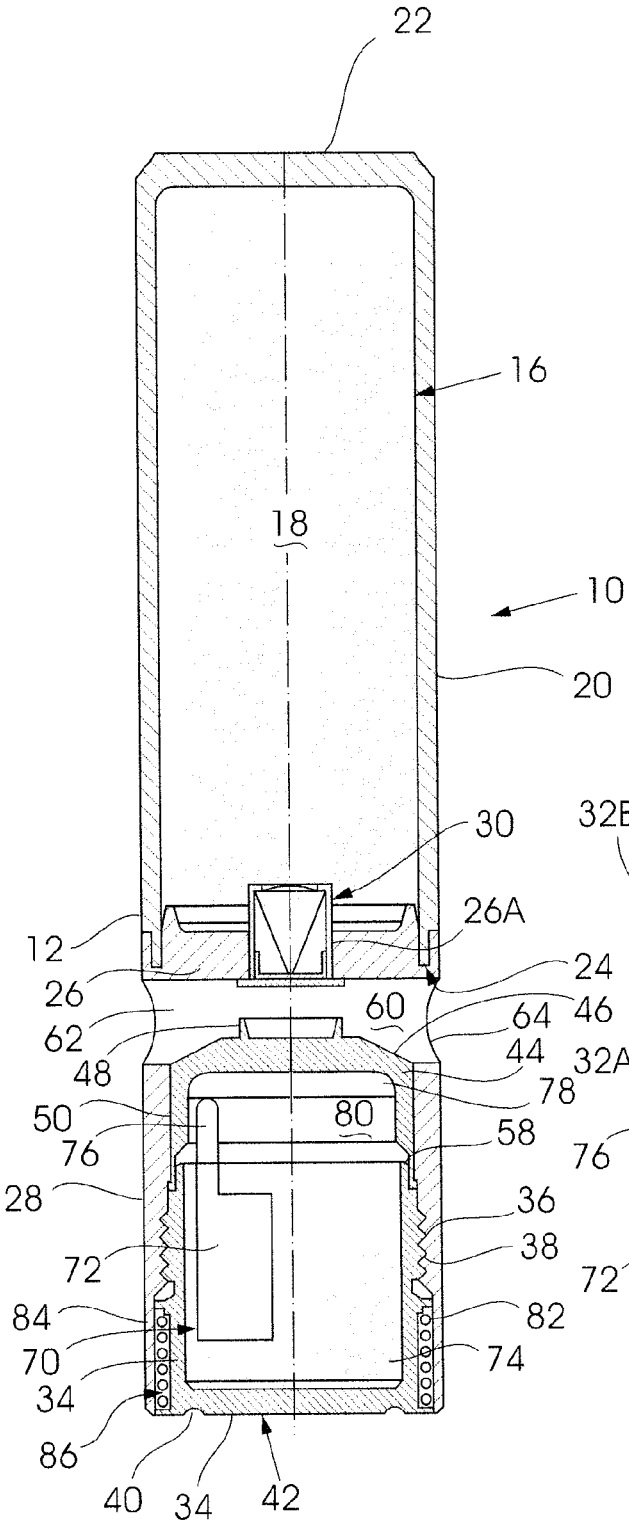
FIG. 1 is a side view in cross-section of a cartridge for breaking rock according to the invention in a non-operative mode.

FIG. 1 of the accompanying drawings illustrates a cartridge 10 according to the invention. The cartridge has a tubular structure or housing 12 in which is formed a first compartment 16. A first energetic composition 18, also referred to herein as the "main charge", fills the first compartment.

The first compartment has an integrally moulded side wall 20 and end wall 22. A mouth 24 to the interior of the compartment, opposing the end wall 22, is sealed by a closure 26 at one end of a tubular component 28. A primer 30, in this case in the form of a centre-fire percussion cap with an anvil, is centrally positioned in an aperture 26A in the closure and is engaged in a watertight manner with the closure, exposed to the first energetic composition. The primer has a casing 32, which is closed by a cover 32A which has an outwardly extending flange 32B, and a central cover section 32C which opposes an anvil 32D. The flange 32B rests on a rim of the aperture 26A.

A cap 34 has an external thread 36 (see as well FIG. 2) which is threadedly engaged with a complemental thread 38 on an inner surface of the tubular component. Formations 40 on an outer surface 42 allow for a mechanised technique for engaging the cap with the tubular component.

A plunger 44, in the form of a shallow socket, is located inside the tubular component 28. The plunger has a central base 46 with a centrally positioned upstanding circular wall 48 on an outer surface which directly opposes the primer 30. A skirt 50 of the plunger is in close contact with an opposing inner surface of the tubular component 28. As is clearly shown in FIG. 2 the skirt, at an end remote from the base, has a reduced thickness portion 52 which terminates in a small outwardly projecting flange 54. The flange closely engages with a small shoulder 56 on an inner surface of the tubular component. The cap 34, at an end which is adjacent the reduced thickness portion 52, has a section 58 which is also of reduced thickness. This section overlies the portion 52.

A fairly large cavity 60 is formed between the closure 26 and the base 46. Opposing apertures 62 and 64, in a wall of the tubular component 28, allow for unimpeded gas and liquid flow between the cavity and a surrounding environment.

The closure 26 is engaged with the side wall 20 at the mouth 24 by means of a frictional weld achieved by rotating the components relatively to each other. This also results in a water-tight seal.

A second compartment 70 is formed inside the assembly of the tubular component 28, the cap 34 and the plunger 44. An electrical circuit 72 is positioned inside the second compartment and is surrounded with a suitable potting agent 74. A fuse head 76, which is connected to the circuit 72, extends from the potting agent into a portion 78 of the second compartment which is filled with a second energetic composition 80, also referred to herein as an "initiating charge".

The potting agent protects the electronic components in the circuit 72. The control technique which is used to operate the circuit 72 is not limited in any respect but, for example, use can be made of the technique described in the specification of South African patent application No. 2007/08012, the content of which is hereby incorporated into this specification. This type of circuit does not include an onboard power supply, for example in the form of a battery. Power required for operation of the circuit and data to control its operation are transferred to the circuit using inductive techniques. According to a preferred feature of this invention an inductive coil 82 which consists of a plurality of windings is wound around a trailing part 84 of the cap 34, adjacent the threaded section 36. The tubular component 28 has a thin wall portion 84 and this feature defines a cavity 86 in which the coil is located in a secure and protected manner.

The cartridge 10, in accordance with the objective referred to hereinbefore, is designed to develop full pressure upon firing of the main charge only if the cartridge is immersed in a water-filled hole in a body of rock. The cartridge remains relatively harmless though during storage, transport and handling.

The main charge, when properly initiated, is capable of breaking rock. The initiating charge 80 has two primary functions. Firstly, when the cartridge is immersed in a water-filled hole in a rock body, firing of the initiating charge creates a pressure pulse in the water that is capable of initiating the primer, as is described hereinafter. Secondly, the pressure pulse which is generated by the initiating charge encapsulates the main charge, within the water, to create a confined environment in which the main charge can deflagrate properly and effectively and thereby produce the required energy-pulse shape, and level of energy, to cause rock breakage.

Figure 3:
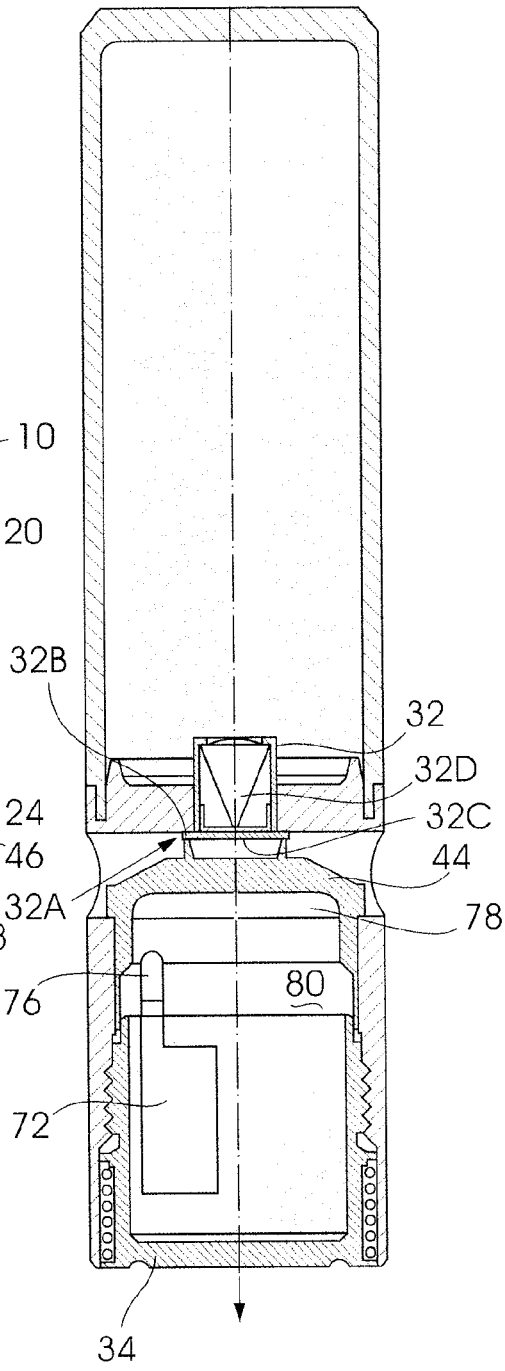
Figure 4:
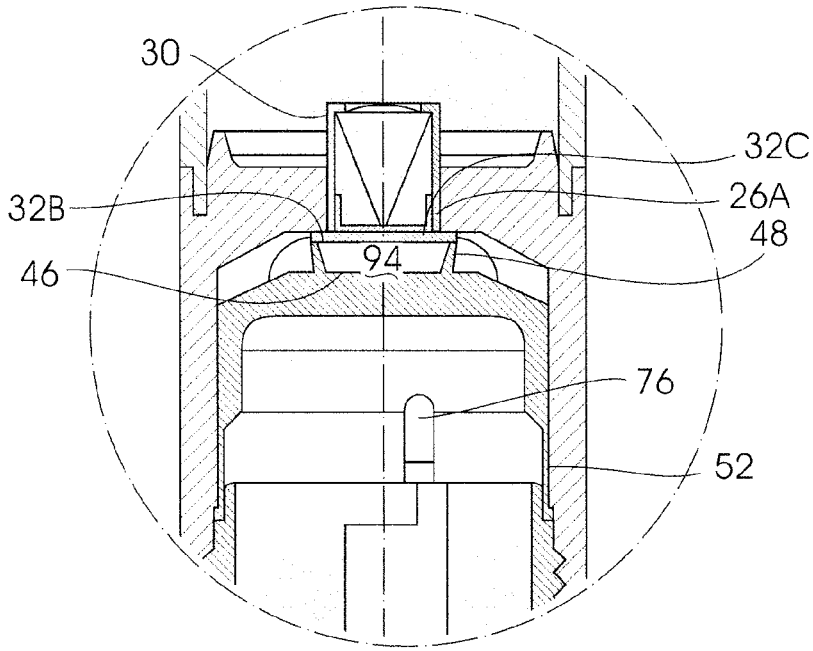

The pressure pulse which is generated by the initiating charge must be focused on the primer in order for the primer to be initiated reliably and timeously. This is achieved in the manner shown in FIGS. 3 and 4 in that the plunger 44 is propelled towards the primer by the force developed by the initiating charge. The plunger initially acts as part of the closure of the initiating charge. However when the fuse head 76 is fired by the circuit 72, generally in accordance with the techniques described in the specification of South African patent application No. 2007/08012, the initiating charge 80 is ignited. Pressure builds up inside the portion 78 of the second compartment and once the force resulting from this pressure exceeds a certain level the flange 54 is broken with a shearing action. The plunger is then free to move and is propelled towards the primer. As the plunger reaches the primer the wall 48 surrounds the cover section 32C of the primer and a leading end of the wall bears against the flange 32B. A quantity of water is trapped in a volume 94 between confining, opposing surfaces of the base 46 and the cover[10] section 32C. This water, which cannot readily escape from the volume 94, is incompressible and as the plunger continues moving toward the primer, the kinetic energy in the plunger and the pressure in the relatively large diameter second compartment 70 are translated into a mechanical force which is exerted by the water in the volume 94 on the cover section 32C. The section is deformed, or otherwise slips inwardly into the casing 32, and is urged towards the anvil 32D by this force. In an alternative process the cover 32A which is frictionally attached to the casing 32 slides into contact with the anvil 32D. The primer interior is pressurized and sensitive material between the anvil and the cover section is thereby initiated in accordance with processes known in the art.

From the aforegoing description it is apparent that the circular wall 48 of the plunger can be equated, in a general sense, to a cylinder which advances towards the cover section 32C of the primer which, again in a general sense, can be regarded as a piston. Thus in one form of the invention it is envisaged that the wall 48 can to a greater or lesser extent surround the section 32C. In an alternative arrangement though a leading end of the wall 48 deforms or crumbles but in such a way that the volume 94 is confined. The high forces which prevail give rise to an effective seal and water cannot escape from the volume to any meaningful extent. A similar effect is observed, for example, if the leading edge of the wall 48 strikes a surface on or adjacent the section 32C provided that surface can deform or yield in a way which prevents any meaningful escape of water from the volume 94.

Figure 2:
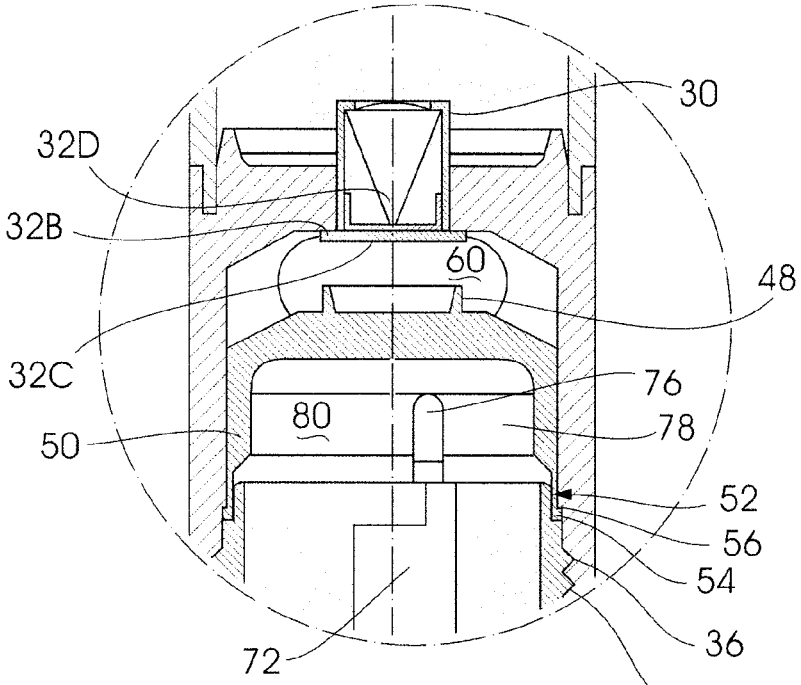
FIG. 2 is a view, angularly displaced by 90° from the view of FIG. 1, and in enlarged detail, of portion of the cartridge shown in FIG. 1, FIGS. 3 and 4 are views which correspond respectively to FIGS. 1 and 2, of the cartridge in an operative mode.
Figure 5:
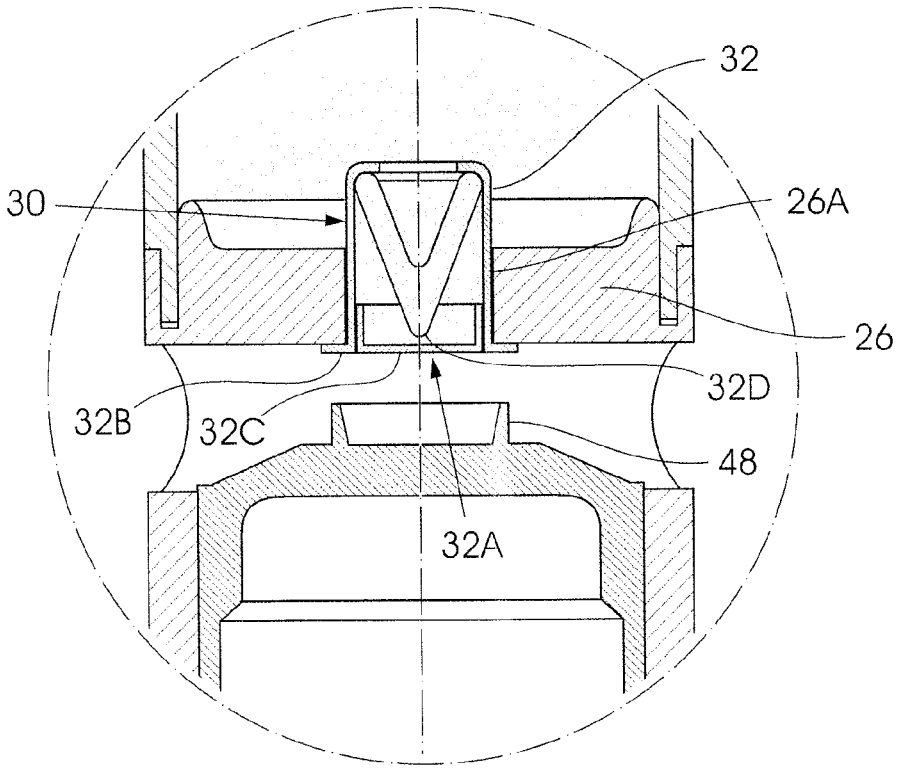
FIG. 5 shows a preferred primer/actuator arrangement for incorporation in the cartridge.

FIG. 5 is similar to FIG. 2 and shows a preferred actuator/primer relationship wherein the flange 32B is a part of the casing 32 and the cover section 32C is separately formed and is in the nature of a cup-shaped piston inside the casing. Thus, when the wall 48 of the actuator strikes the flange 32B substantially all of the force transmitted in the volume 94 is[11] transferred into the cover section which is thereby urged towards the anvil These various effects or processes can be used alternatively or in any appropriate combination to ensure that an effective transfer of force takes place to the primer.

Another factor which leads to the creation of a higher pressure inside the primer and hence ensures effective and reliable initiation of the primer charge lies in the fact that the diameter of the plunger 44 is meaningfully larger than the diameter of the circular wall 48. Although the full force generated inside the plunger is available at the circular wall it follows that as the area enclosed by the wall 48 is significantly less than the cross-sectional area of the plunger the pressure generated on the confined water, between the actuator and the primer, is significantly increased. The primer contains highly sensitive material which is then reliably initiated by the force transmitted by the advancing plunger.

The cavity 60 between the plunger and the primer is devoid of air, when the cartridge is immersed in water. The apertures 62 and 64 are such that any air which may initially be trapped in the cavity readily escapes to surface through the water. This is important because air is compressible and, if air is in the cavity when the cartridge is in water, maximum force is not transmitted to the primer. If however the fuse head is accidentally or intentionally fired while the cartridge is in air, although the plunger will be propelled towards the primer, a small volume of air will be trapped in the volume 94 but, as air is compressible, the force which is generated on the primer will not be sufficient to cause detonation of the primer.

The initiating charge is a relatively small quantity of propellant and the firing thereof, outside of a hole in a rock, will normally not lead to significant bodily harm, nor to damage to equipment.

The side wall 20 is thin in order to maximise the amount of the main charge which can be held inside the first component. Thus the side wall cannot withstand sufficient pressure when the main charge is initiated to allow for proper deflagration of the main charge. Upon firing of the initiating charge the plunger is propelled towards the primer. The plunger displaces water thereby generating a pressure wave, which is transmitted through the apertures 62 and 64 to the surrounding water, which acts on the outer surface of the side wall 20. This establishes the required confinement mechanism to allow for proper deflagration of the main charge and hence pressure build-up in the cartridge.

The events which take place between the firing of the initiating charge and the initiation of the main charge, occur in milliseconds. It is critical to the proper firing of the main charge that the pressure wave which is generated by the initiating charge must surround the main charge when it is initiated. Bad timing in this respect will degrade the performance of the cartridge. However if the timing and constructional aspects embodied in the cartridge are correct then proper and efficient deflagration of the main charge occurs. The sudden release of energy, as the structure 12 bursts, imparts to the water in the hole a pressure wave which is transferred to the surrounding rock in the form of a stress wave which initiates cracks in the rock.

Preferably, upon initiation of the second energetic composition, a pressure wave is created in the liquid which acts as a confinement mechanism at least around the first compartment when the first energetic composition is ignited.

The invention claimed is:

1. A cartridge for breaking rock which includes a tubular housing in which is formed a first compartment, a first energetic composition inside the first compartment, a primer which is exposed to the first energetic composition, a second compartment inside the tubular component, a plunger inside the tubular component which is movable under explosive force towards the primer, a second energetic composition inside the second compartment, an actuator and a fuse for initiating the second energetic composition, wherein the actuator has an area which is smaller than the cross-sectional area of the plunger and is movable, by movement of the plunger, towards the primer, whereby a quantity of liquid is trapped by the actuator and the primer in a volume between the actuator and the primer, and wherein the primer is initiated by force transmitted from the actuator through the confined liquid in said volume to the primer.

2. A cartridge according to claim 1 wherein the plunger includes a flange which is engaged with the tubular component and which is sheared, upon initiation of the second energetic composition, thereby to allow movement of the plunger towards the primer.

3. A cartridge according to claim 1 wherein the primer and the actuator have complementary formations which are engageable thereby to trap liquid in the volume between the actuator and the primer.

4. A cartridge according to claim 3 wherein the complementary formations comprise a piston and cylinder.

5. A cartridge according to claim 1 wherein a part of the actuator is deformable to allow for pressure on liquid in the volume to be increased.

6. A cartridge according to claim 1 wherein the second compartment is formed inside the tubular housing which includes at least one aperture formed in a wall of the housing to place the volume in communication with liquid which surrounds the housing when the housing is immersed in the liquid.

7. A cartridge according to claim 1 which includes an electrically controlled mechanism for firing the fuse and an antenna for providing an input signal to the electrically controlled mechanism wherein the mechanism is positioned inside the second compartment.

8. A method of initiating a first energetic composition which includes the steps of:

(a) confining a quantity of the first energetic composition in a compartment, (b) exposing a primer to the first energetic composition, (c) loading the compartment into a borehole, (d) surrounding the compartment in the borehole with water, (e) igniting a second energetic composition in the water thereby to exert pressure on a plunger and to propel the plunger towards the primer, (f) using the plunger to move an actuator towards the primer whereby;

i) a quantity of water is trapped by the actuator and the primer in a volume between the actuator and the primer; and ii) the actuator pressurizes the confined water in said volume; and iii) using the confined water to transmit force from the actuator to the primer thereby to fire the primer and so initiate the first energetic composition.

9. A method according to claim 8, further comprising the step of using the second energetic composition to create a pressure wave in the water in the borehole which confines the first energetic composition when the first energetic composition is initiated.

10. A cartridge for breaking rock which includes a tubular housing in which is formed a first compartment, a first energetic composition inside the first compartment, a primer which is exposed to the first energetic composition, a second compartment inside the tubular component, a plunger inside the tubular component which is movable under explosive force towards the primer, a second energetic composition inside the second compartment, an actuator and a fuse for initiating the second energetic composition, wherein the actuator has an area which is smaller than the cross-sectional area of the plunger and is movable, by movement of the plunger, towards the primer, whereby a quantity of liquid is confined in a volume between the actuator and the primer, and wherein the primer is initiated by force transmitted directly from the confined liquid in said volume to the primer.

* * * * *